United States Patent [19]

Rethemeyer et al.

[11] 3,984,048

[45] Oct. 5, 1976

[54] PLEATING DEVICE

[76] Inventors: Fritz Rethemeyer; Alice Rethemeyer, both of 51 Island Way, Apt. 109, Clearwater, Fla. 33515

[22] Filed: Oct. 14, 1975

[21] Appl. No.: 622,109

[52] U.S. Cl. ..... 223/35

[51] Int. Cl.[2] ..... A41H 43/00; D05B 35/08; D06J 1/00

[58] Field of Search ..... 223/28, 34, 35, 36; 160/348; 132/31 R, 32 R, 32 A, 32 B, 37 R; 112/130, 136, 144, 147

[56] References Cited

UNITED STATES PATENTS

| | | | |
|---|---|---|---|
| 1,166,174 | 12/1915 | Bisbee | 223/35 |
| 2,669,955 | 2/1954 | Gellman | 112/136 |
| 3,576,281 | 4/1971 | Morana | 223/34 |
| 3,889,858 | 6/1975 | Hack | 223/35 |

*Primary Examiner*—G. V. Larkin
*Attorney, Agent, or Firm*—Stanley M. Miller

[57] ABSTRACT

A simple manual drapery pinch pleater used to form the "butterfly" or "pinch" pleat in draperies having a handle from which extends a trifurcated inwardly foldable fin for uniform formation of successive pinch pleats.

1 Claim, 3 Drawing Figures

PLEATING DEVICE

BACKGROUND OF THE INVENTION

1. Field of the Invention

This invention relates generally to pleating devices and more particularly relates to a device which can be used in a simple manual operation to form neat "butterfly" or "pinch" pleats in draperies.

2. Description of the Prior Art

In the fabrication of window drapes, table skirting and other decorative fabric applications, one of the best known and favorite pleats used is the one commonly known as the butterfly or pinch pleat. As is well known within the art, the uniform articulation and formation of these attractive pleats can be a difficult skill to acquire. In order to facilitate the learning of this skill and indeed to apply this skill, once learned, with continued expertise, the simple device herein presented accomplishes these endeavors. Easily fabricated of laminated stiff cardboard or injection molded of polystyrene plastic or similar materials, this invention can be mass produced cheaply and readily marked to both professional and amateur drapery faricators alike.

SUMMARY OF THE INVENTION

It is, therefore, an object of this invention to simply and manually produce the commonly known butterfly or pinch pleat in draperies.

These objects and others are carried out by the particular pleating device as shown and described herein.

BRIEF DESCRIPTION OF THE DRAWINGS

In order to better understand the nature and function of the present invention, we refer now to the drawings in which like numerals and characters apply to like parts of the invention, and in which.

DESCRIPTION OF THE PREFERRED EMBODIMENT

Figure 1:
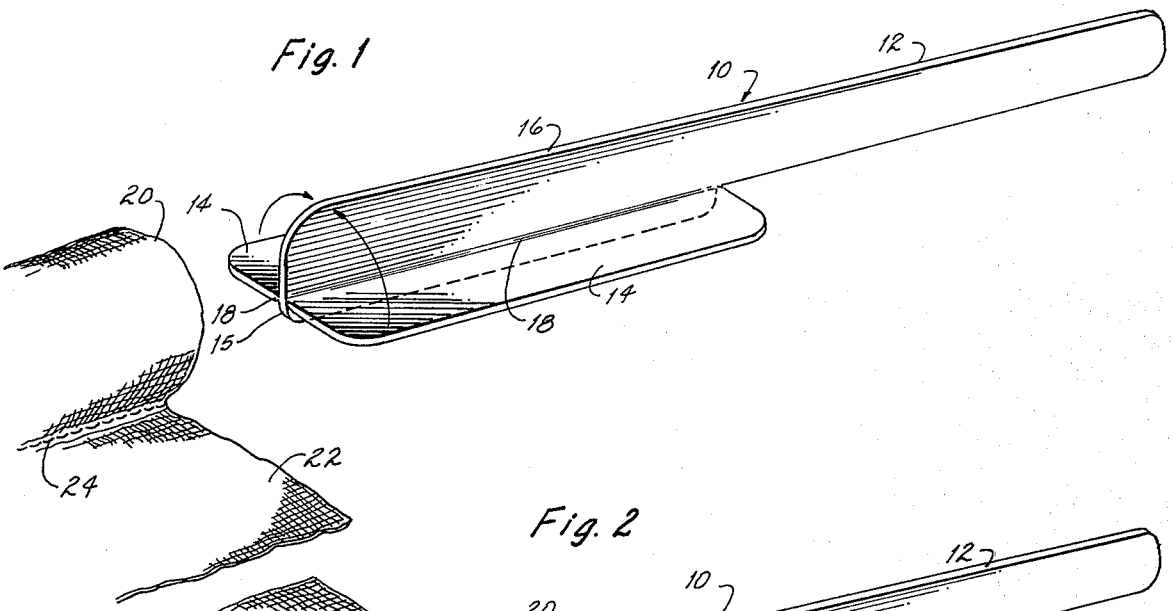
FIG. 1 is a perspective view of a preferred configuration of the invention and a presewn tubular portion of a window drape.
Figure 2:
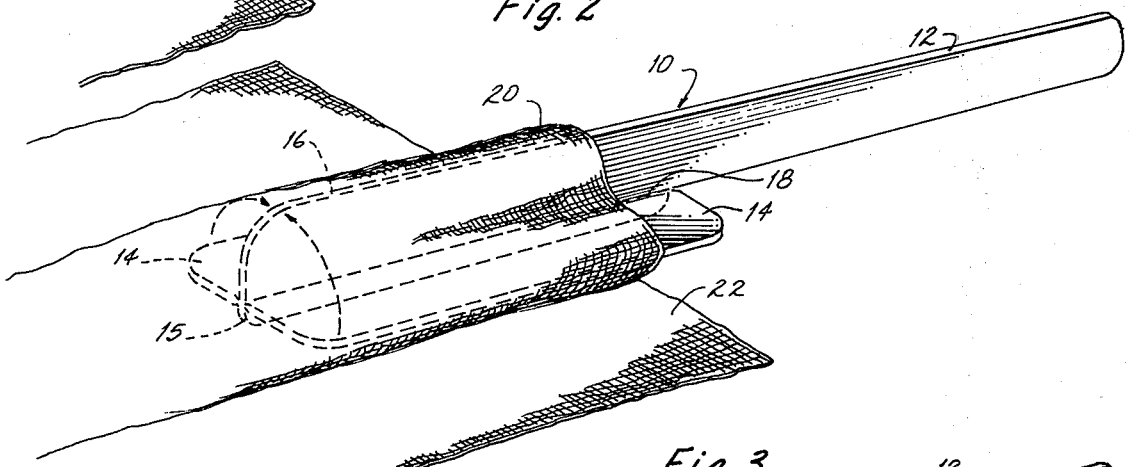
FIG. 2 is a perspective view of the invention inserted into the presewn tubular portion of a window drape shown in FIG. 1.
Figure 3:
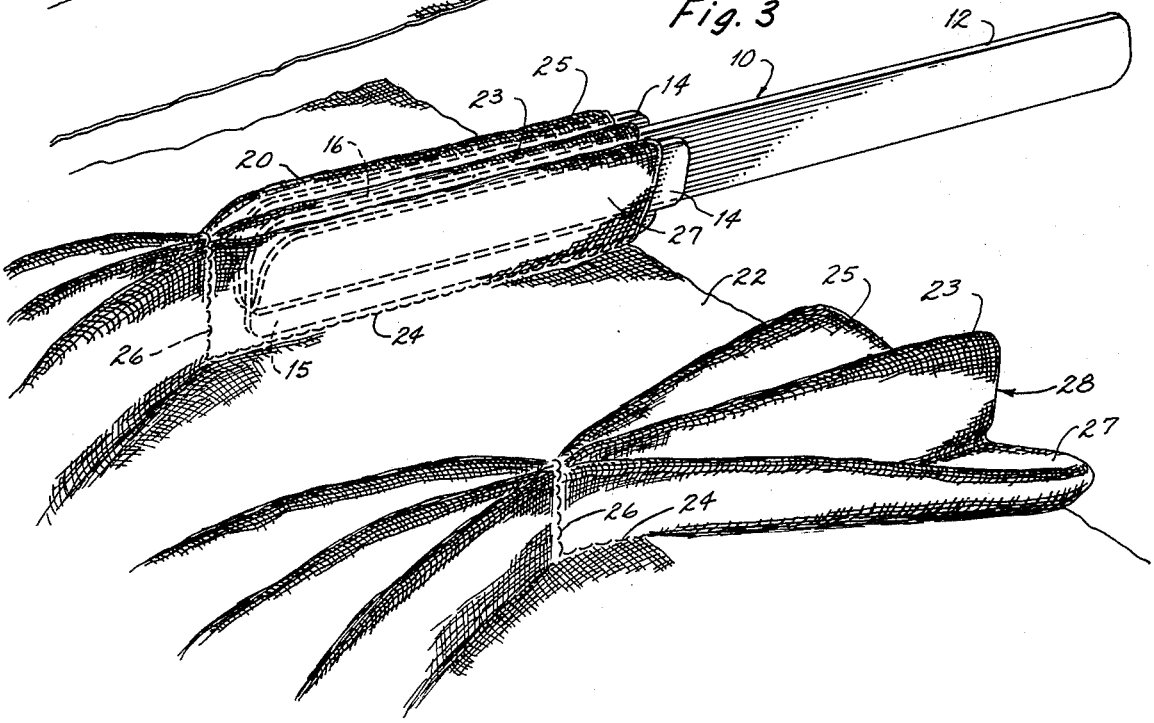
FIG. 3 is a perspective view of the invention inserted and folded inwardly within the presewn tubular portion of the window drape of FIGS. 1 and 2, and a completed "butterfly" pleat in the adjacent portion of the window drape.

Referring first to FIG. 1, the numeral 10 (with arrow) indicates the overall invention, comprised of a handle 12 and a pair of generally flat fins 14 disposed at 90 degrees to the vertical fin extension 16 of the handle 12. It should be noted that at the junctures of the fins 14, a relatively small portion 15 of the central fin 16 extends below said junctures. The purpose of this continuous protrusion 15 is to serve as a guide and stabilizer within the seam 24 which is hereinafter described. The invention, preferably fabricated of stiff cardboard or semi-rigid plastic, incorporates a continuous pliable crease 18 at the points of juncture of the fins 14 to the vertical pin 16. All corners of all fins and handle are shown rounded to preclude snagging or damaging the drapery fabric. The pliable creases 18 provide a hingable means of folding the fins 14 inwardly after insertion of the invention into the presewn tubular portion 20 of the drape 22 as indicated in FIGS. 1 and 2. Presewn stitching 24 forms a tubular portion 20 approximately 3 inches long and 1 ½ inches in diameter, more or less, according to the discretion of the sewer. Progressing from the insertion of the invention into the presewn tube shown in FIG. 2, FIG. 3 shows the fins 14 folded inwardly, with the excess portion of fabric in the tube carefully pinched between the fins 14 and extension 16 forming the butterfly pleat wings 25 and 27 and center pleat 23. With the fabric held in this configuration, additional stitching 26 is applied at approximately 90° to stitching 24. Withdrawal of the invention from the formed pleat may be done either prior or subsequent to application of stitching 26 at the discretion of the sewer, since the primary purpose of the invention, as previously stated, is to facilitate uniformly articulated butterfly or pinch pleats in draperies or the like, by either experienced or inexperienced sewers. Shown at 28 in FIG. 3 is a completed butterfy or pinch pleat in a window drape.

What we claim is:

1. A manual drapery pinch pleater for forming butterfly or pinch pleats comprised of a center fin, a pair of fins inwardly foldable toward the center fin and disposed generally at 90° angle to the center fin, said center fin having a relatively small portion extending below its juncture with the pair of fins.

* * * * *